United States Patent [19]

McCann

[11] 4,158,243

[45] Jun. 19, 1979

[54] EASY CLEAN LAVATORY

[76] Inventor: William E. McCann, 540 S. Forest Ave., Mesa, Ariz. 85204

[21] Appl. No.: 820,095

[22] Filed: Jul. 29, 1977

[51] Int. Cl.[2] ..... E03C 1/182; E03C 1/186

[52] U.S. Cl. ..... 4/166; 4/187 R; 4/192

[58] Field of Search ..... 4/166, 167, 187 R, 192, 4/194; D23/58, 63, 64

[56] References Cited

U.S. PATENT DOCUMENTS

| | | | |
|---|---|---|---|
| 208,094 | 9/1878 | Higgins | 4/187 R |
| 247,297 | 9/1881 | Bond | 4/203 |
| 3,451,068 | 6/1969 | Phillips, Jr. | 4/166 |
| 3,508,282 | 4/1970 | Phillips, Jr. | 4/166 |
| 3,629,876 | 12/1971 | Wright | 4/166 |

FOREIGN PATENT DOCUMENTS

| | | | |
|---|---|---|---|
| 1032899 | 4/1953 | France | 4/192 |
| 1398051 | 3/1965 | France | 4/166 |

*Primary Examiner*—Richard R. Stearns
*Attorney, Agent, or Firm*—Warren F. B. Lindsley

[57] ABSTRACT

Improved lavatory, sink and bathtub configurations are disclosed for eliminating protruding hardware on their rims thereby preventing water from being spilled on the rims of the fixtures during use from wet hands controlling the water valves.

9 Claims, 17 Drawing Figures

EASY CLEAN LAVATORY

BACKGROUND OF THE INVENTION

This invention relates to new and useful improvements in lavatories, handsprays, water valves, pop-up drains and soap dishes attached thereto, and more particularly to a new and novel arrangement of the plumbing fixtures so that they may be used without splashing up the drain boards, rails or surfaces of the metallic, synthetic or blended plastic materials of the appliance.

DESCRIPTION OF THE PRIOR ART

The present day lavatories having plumbing fixtures mounted on splash rails, decking and the like are difficult to operate with wet hands without splashing up the fixture as well as the appliance or installation.

U.S. Pat. Nos. 1,930,633 and 3,508,282 disclose recessed water supply spouts.

U.S. Pat. No. 1,288,013 discloses a soap dish below the operating handle of an outlet valve, both being arranged inside of the bowl of the appliance.

U.S. Pat. No. 3,583,003 discloses a plastic trap loop and U.S. Pat. No. 892,366 discloses a soap dish inside of the bowl of the appliance.

U.S. Pat. Nos. 1,931,568; 3,025,085; 3,314,082 and 3,387,309 disclose drain or supply manipulators which are mounted within the bowl.

None of these patents disclose the claimed conventional lavatory having the plumbing fixtures protrude from the bowl rim in such a manner that they may be operated without splashing up the lavatory.

SUMMARY OF THE INVENTION

In accordance with the invention claimed, new and improved plumbing appliances are provided which through their unique design permit operation of its plumbing fixtures without splashing up the surfaces of the appliance.

It is, therefore, one object of this invention to provide a new and improved lavatory without the conventional water spout, hot and cold water valve controls and pop-up drain control rod mounted on and protruding from the rim of the bowl of the lavatory.

Another object of this invention is to provide an improved lavatory, the operating levers of which lie in a substantially horizontal plane defined by the rim of its bowl with the water valve operating levers being a part of the rim of the bowl.

A further object of this invention is to provide an improved lavatory having an elevated rim located at a point away from the operator, the rim being elevated from 3 to 6 inches at that point and sloping downwardly to the opposite rim directly in front of the lavatory user.

A still further object of this invention is to provide a lavatory having its pop-up drain control valve located inside the rim of the lavatory next to the operator in the drain opening opposite the water valve operating levers to prevent water from being deposited on the rim during the act of operating the pop-up drain control rod with wet hands.

A still further object of this invention is to provide a combination water spout and spray movable upwardly or downwardly on its hinged attachment to the lavatory rim and also being removable from its normal position on the rim to be used as a handspray.

A still further object of this invention is to provide an improved lavatory having a removable soap dish under the rim and supported by means fastened to holes in the lavatory sump wall and supported from the rim.

These together with other objects and advantages which will become apparent reside in the details of construction and operation as will be more fully described and claimed, reference being made to the accompanying drawings forming a part hereof, wherein like numerals refer to like parts throughout.

DESCRIPTION OF THE PREFERRED EMBODIMENT

Figure 1:
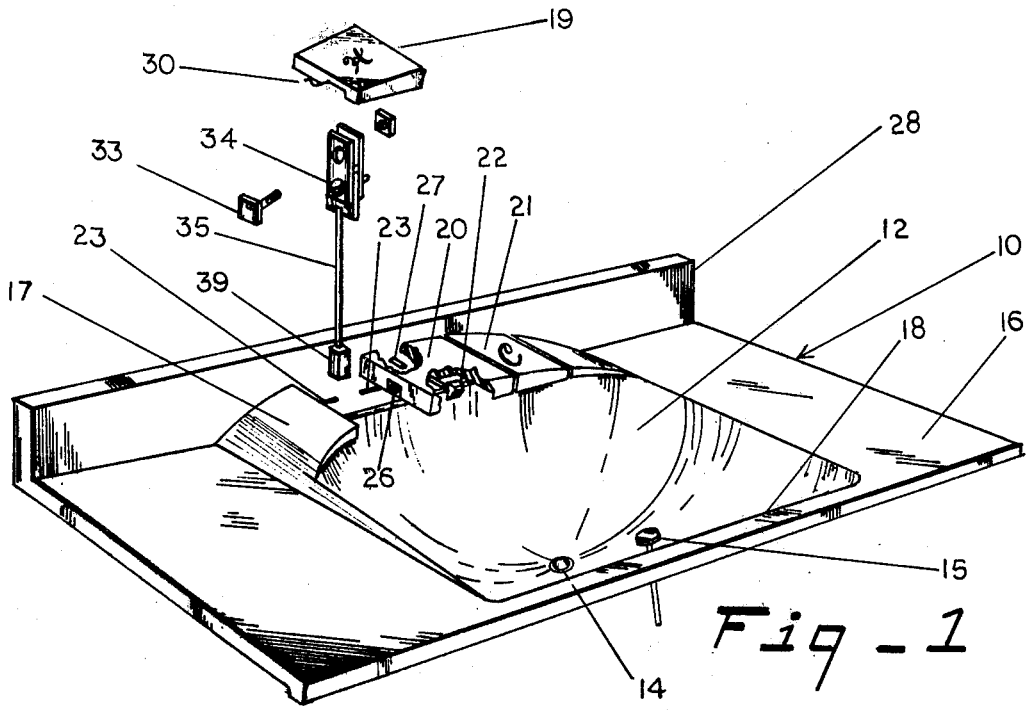
FIG. 1 is an isometric view of a lavatory embodying the invention having a portion of the water spout compartment broken away and the water valve operating lever connecting linkage shown in an exploded view.

Referring more particularly to the drawings by characters of reference, FIG. 1 discloses a plumbing fixture 10 comprising a sump section 12 having a pop-up drain valve 14 and drain control rod 15 located therein. A ledge 16, having an elevated rim extending inwardly therefrom forms an arc 17 having upwardly and downwardly movable and removable segments 19 and 21 forming the hot water and conventional cold water valve actuating levers, respectively.

A water spout 22 is housed in a housing 20 which is fastened to a non-corrosive metal angle bracket 25 by means of non-corrosive fastening means 26. Housing 20 is supported at its rear by means of non-corrosive metal dowel rods 27 which protrude from a rear vertical wall 28 of the plumbing fixture and extend into holes 29 in housing 20.

Figure 2:
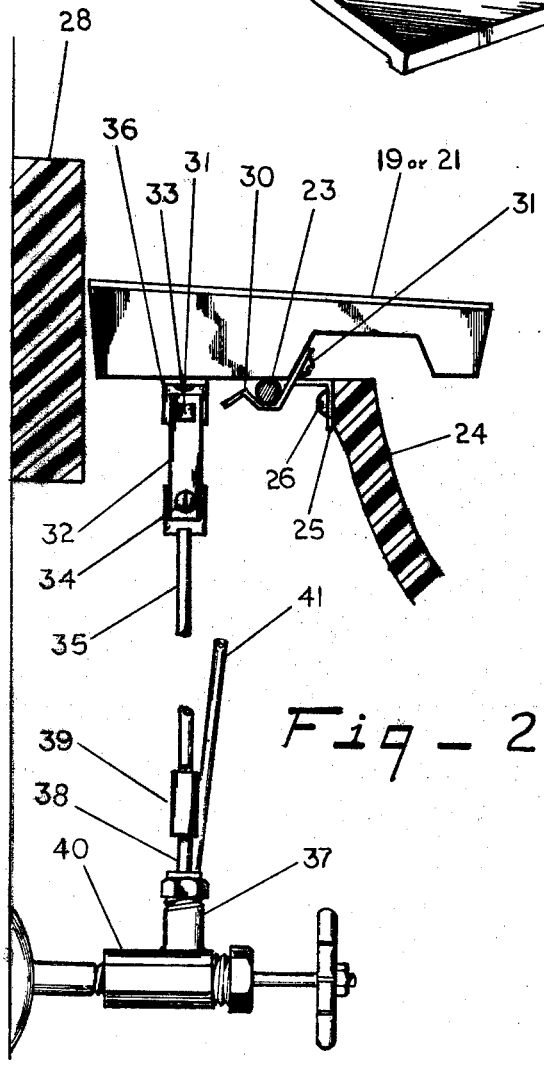
FIG. 2 shows a side view of the water valve control lever linkage and water supply valve of the lavatory shown in FIG. 1.

FIG. 2 illustrates that the hot and cold water valve actuating levers 19 or 21 are hingedly attached to the lavatory by means of non-corrosive flexible hinges 30 which cooperate with non-corrosive hinge pins 23. Hinges 30 are fastened one to each of levers 19 and 21 by threaded retaining means 31 or any other suitable means. Hinge 30 and pin 23 cooperate as a unit to allow levers 19 or 21 to be removed from the lavatory rim 17 for maintenance of water valves and associated linkage mechanisms.

When a pulling force is applied to levers 19 and 21, moving them away from vertical wall 28, the force exerted by levers 19 and 21 on flexible hinges 30 and the resisting force of hinge pins 23 cause the flexible spring hinge 30 to open as the connecting link 32 rotates on removable hinge pins 33 and 34. This action causes levers 19 and 21 to move forwardly, allowing spring hinge 30 to become disengaged from hinge pin 23. Levers 19 and/or 21 are then lifted upwardly, enabling removal of bolted hinge pins 33, thereby permitting levers 19 and 21 to be removed from rim 17. The procedure is reversed when replacing levers 19 or 20 in the plumbing fixture. The flexible spring hinge 30 and hinge pin 23 cooperate with each other and act as a fulcrum, allowing levers 19 and 21 to rotate on hinges 30 to move downwardly, thereby applying a lifting force upwardly at hinged "T" connector 36 joining link 32 to levers 19 and 21. This occurs by means of removable pin 33 and threaded fastening means 31 connecting "T" connector 36 to levers 19 or 21.

When the front portion of the water valve actuating levers 19 and 21 are first depressed, the rear portion of the levers 19 and 21 move upwardly revolving around their fulcrums. The attached link 32 moves upwardly. The force transmitted by link 32 to valve actuating rod 35 through hinge pin 34 causes the modified conventional water valve cartridge to move upwardly in valve chamber 37 revealing an opening in valve chamber 37 allowing water to flow to spout 22 through pipe 41.

Figure 3:
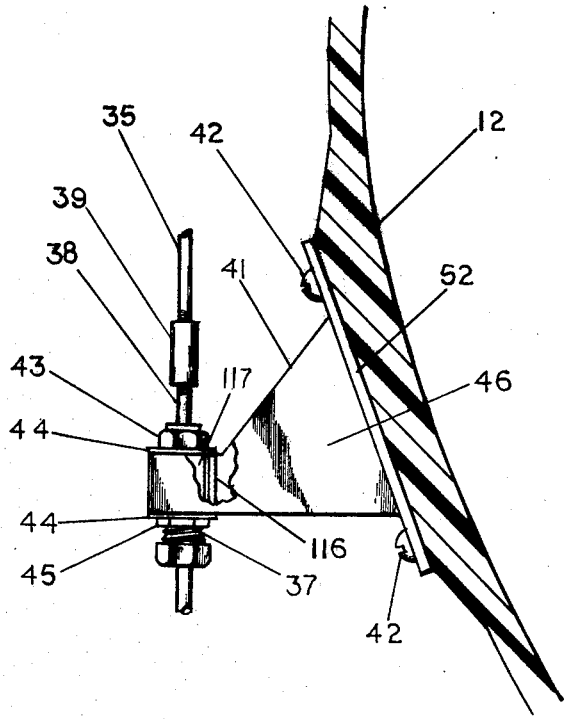
FIG. 3 shows the water supply control valve mounted on the lavatory sump wall.

Referring now to FIG. 3, conventional water valve 37 is shown as being mounted on lavatory sump section wall 12 by means of a mounting bracket 41 which is attached to wall 12 by threaded fastening means 42 cooperating with threaded holes in sump wall 12. Valve 37 is housed in bracket 41 having a slot whose sides are formed by two parallel metal side plates 46 perpendicularly attached to a base plate 52 by welding or other suitable means. Plates 46 have a metal spacer 116 weldably attached therebetween and form a pocket to receive valve 37 with valve 37 being retained in pocket 117 by nut 43 and washer 44 cooperating with nut 45 and washer 44.

Figure 4:
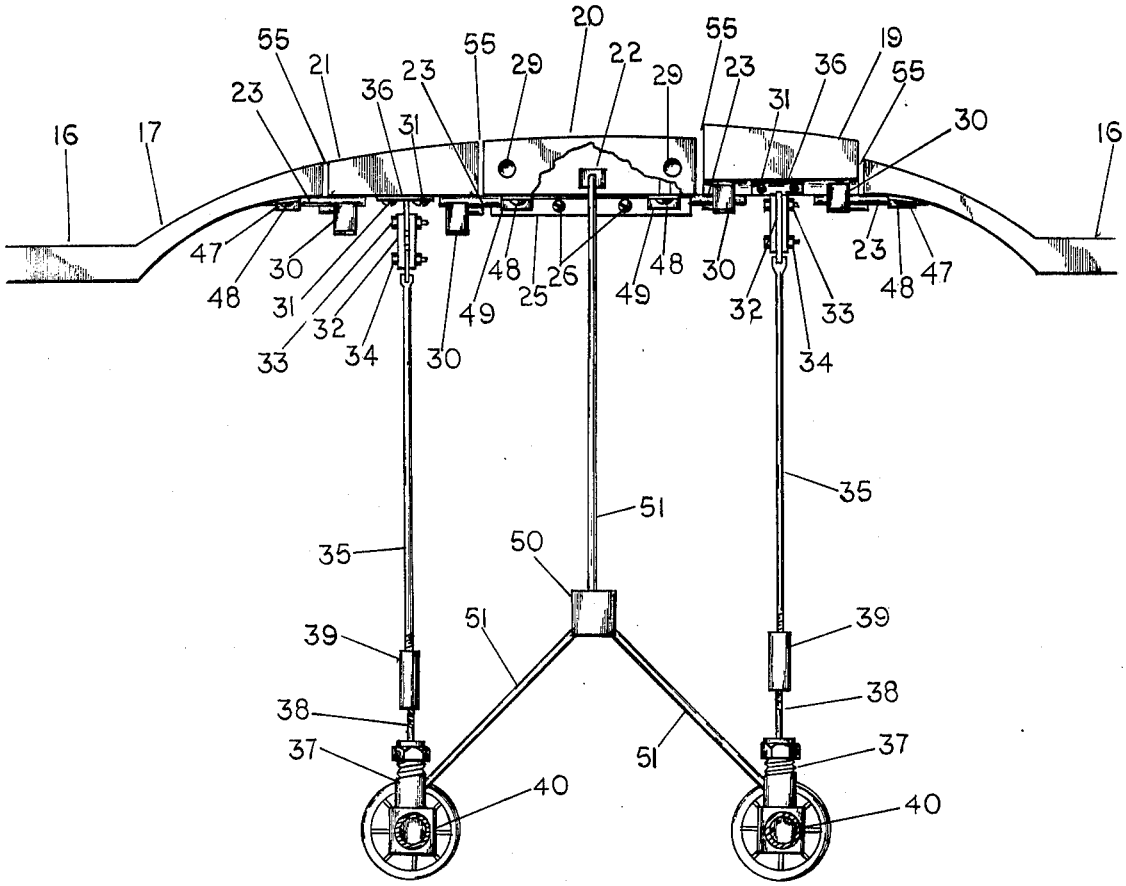
FIG. 4 is a rear elevational view at the rim of the lavatory showing levers, linkage, water valves and supply lines.

FIG. 4 illustrates a rear view of the water valve actuating levers 19 and 21 which are hingedly attached to rim 17 by means of mounting bracket 47 cooperating with hinge pins 23 and are further hingedly attached to water spout housing 20 by mounting bracket 49 cooperating with hinge pins 23 and tapered spring hinge 30. Valve 21 is shown in a closed position with valve 19 shown in a lifted or open position causing water to flow through valve 37, pipe 51, tee 50 to water spout 22.

Figure 5:
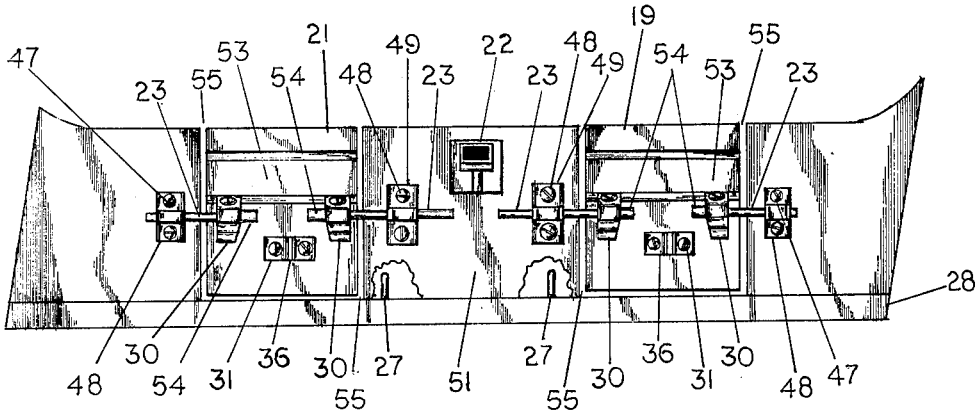
FIG. 5 is a bottom view of FIG. 4 showing attaching arrangement for spout housing and water value operating levers.

In FIG. 5, numeral 53 denotes the depressed offset in the levers allowing levers 19 and 21 to travel downwardly toward the upper edge of sump wall 12 when turning on the water supply to spout 22. A boss 54 on hinge pin 23 cooperates with tapered spring hinge 30 to maintain an acceptable gap 55 between levers 19 and 21 and adjacent parts of rim 17 during operation of levers 19 and 21. Tapered spring hinge 30 is tapered on the side adjacent to boss 54 allowing sufficient clearance between them upon initial contact of hinge pin 23 and tapered spring hinge 30 to enable the levers 19 and 21 to be easily installed on rim 17.

Figure 6:
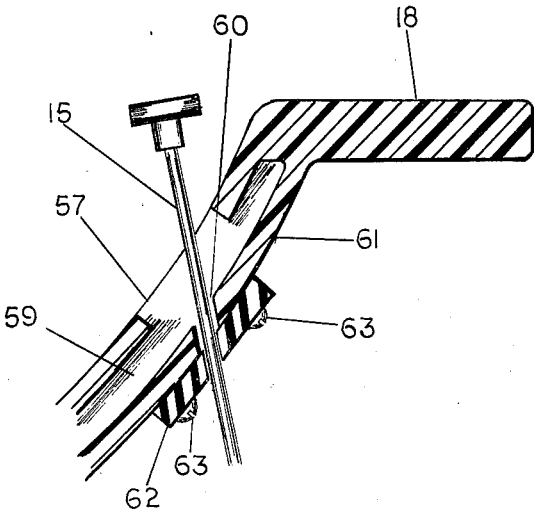
FIG. 6 is a sectional view showing the pop-up drain control rod.

FIG. 6 illustrates a drain opening 57 through which a conventional drain pop-up valve control rod 15 passes into drain passage 59 through opening 60 in drain passage wall 61 and stabilizing collar and sealer 62 fabricated from rubber, plastic or other suitable material and held in place by threaded fastening means 63 cooperating with threaded holes in wall 61.

Figure 7:
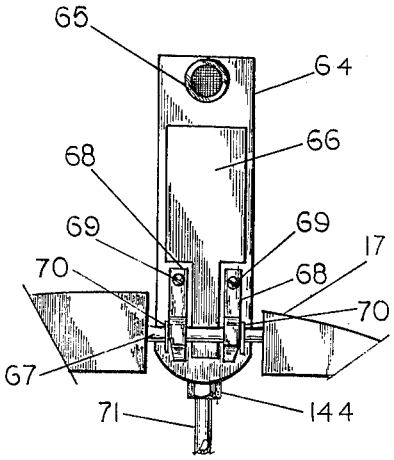
FIG. 7 is a view of the spout-spray mechanism in an elevated position.
Figure 8:
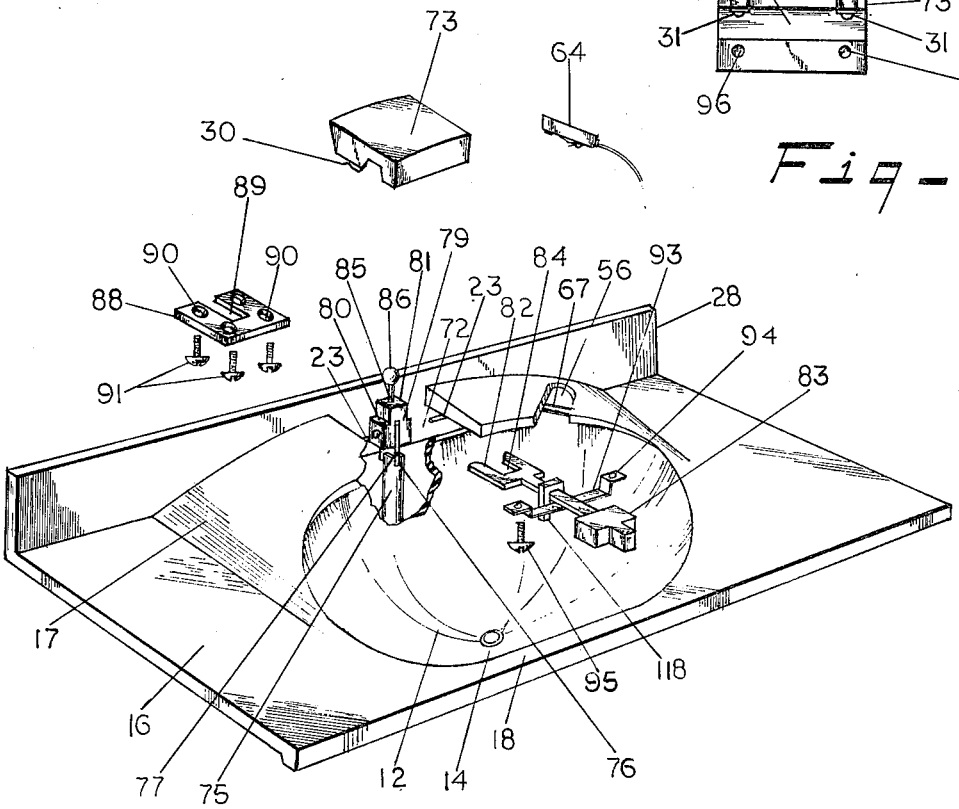
FIG. 8 is an isometric view having a portion of the rim and sump wall broken away with the water control lever, combination water spout-hand spray and connecting linkage shown in an exploded view.

FIG. 7 illustrates a combination water spout and spray 64 shown in a raised angular position on rim 17 which may be used as a hair spray in a stationary position on rim 17 or removed as shown in FIG. 8. The combination spout and spray 64 has a water orifice 65 for delivering a water supply to sump 12. This water supply is controlled by a water valve control 66 which controls flow through orifice 65 when in its normal position in opening 56 on rim 17 and held in an open position by the cooperation of hinge pin 67 and the pressure applied by spring hinges 68 suitably secured to spout-spray 64 by threaded fastening or other means 69. The spout-spray is held in proper alignment on the hinge pin by boss 70. Hinge pin 67 may be cast in rim 17 or suitably fastened thereto by other means. Numeral 71 denotes a flexible water supply hose connected to spout-spray 64. As shown in FIG. 7, nut 144 cooperates with the threaded inlet pipe of spout-spray 64 to secure water supply hose 71 to said spout-spray 64.

Figure 9:
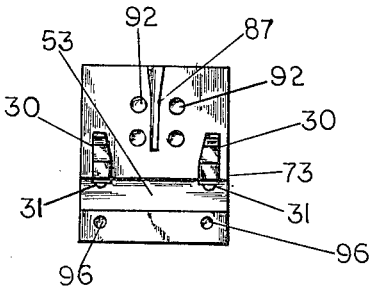
FIG. 9 is a bottom view of water valve control levers shown in FIG. 8.
Figure 12:
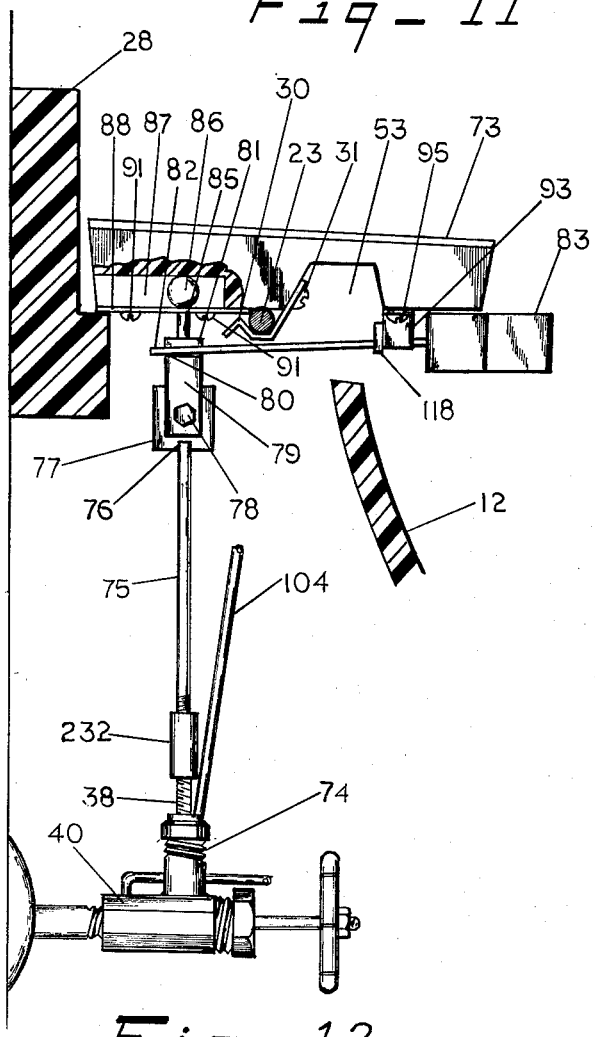
FIG. 12 shows a side view of a water valve actuating lever, water temperature adjusting control and connecting valve linkage.

In FIGS. 8, 9 and 12 the elevated rim 17 is provided with an opening 72 for receiving water valve control actuating lever 73 which is retained in rim 17 by bossed offset hinge pins 23 cooperating with flexible tapered hinges 30. Lever 73 is designed to function with a conventional single combination hot and cold water valve 74 having water valve control rod 75 connected to valve 74 by threaded valve stem 38 connected to rod 75 by threaded connector 232. Rod 75 is provided with a slotted end 76 to receive connection plate 77 which may be welded, brazed or attached in any other suitable manner to plate 77. Plate 77 is provided with a hole to receive hinge pin 78 or any other bolt and nut arrangement for connecting plate 77 to driving means 79. Driving means 79 is slotted to receive plate 77 and has a hole for receiving pin 78 with pin 78 passing through plate 77 and driving means 79. Driving means 79 is offset at the upper portion thereof to form ledge 80 and its oblong shaped extension 81 is located on its central axis rising vertically upwardly therefrom. Extension 81 has a smaller physical size in one dimension than driving means 79 forming ledge 80 which supports the pronged end 82 of water temperature controlling lever 83. The oblong shaped extension 81 tightly fits into slot 84 formed by prongs of end 82 enabling lever 83 to rotate valve connecting rod 75 in a circular manner on its central axis from right to left or left to right to change the temperature of the water being supplied to spout 64.

Shaft 85 rises vertically upward on the central axis of extension 81 and having a ball 86 at its extreme end. Ball 86 snugly fitting into slot 87 of lever 73 with slot 87 being tapered somewhat at its end to allow for easy installation of ball 86 into slot 87 of lever 73. Ball 86 is retained in slot 87 by means of retaining plate 88 which is provided with a slot 89 allowing lever 73 to be removed from ball 86. Water temperature control lever 83 is also slotted to allow removal and installation of lever 73. A retaining plate 88 having holes 90 accomodates a threaded fastening means 91 which cooperates with holes 92 in lever 73 thereby acting as a retaining means for ball 86 positioned in slot 87. The water temperature control lever 83 is retained in its position under lever 73 by means of supporting bracket 93 having holes 94 in its outer extremities. Holes 94 are provided to receive threaded fastening means 95 cooperating with holes 96 to fasten bracket 93 to lever 73 retaining lever 83 in proper position under lever 73. Lever 83 is retained in its proper position under lever 73 by retaining plate 118 fastened to the shaft of water temperature control lever 83. A plate 118 located adjacent to bracket 93 maintains lever 83 in its proper functioning position with drive 79.

Figure 10:
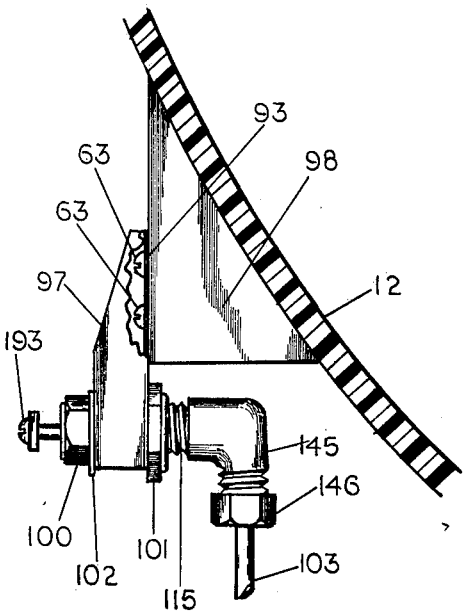
FIG. 10 is a sectional view showing a water valve horizontally mounted on a built-up area of the lavatory sump wall.

FIG. 10 illustrates a water valve 115 vertically positioned on mounting bracket 93 which in turn is vertically mounted on protuberance 98 on sump wall 12 by threaded fastening means 63. Mounting bracket 93 having plates 97 perpendicularly mounted by welding or other suitable means forms a slot 99 for tightly fitting valve 115 which is slidably positioned in slot 99 and secured in a desirable position by the cooperation of nuts 100 and 101, washer 102 and threaded valve body 115. Water supply 103 and water outlet 104 are attached to threaded elbow 145 by nut 146.

Figure 11:
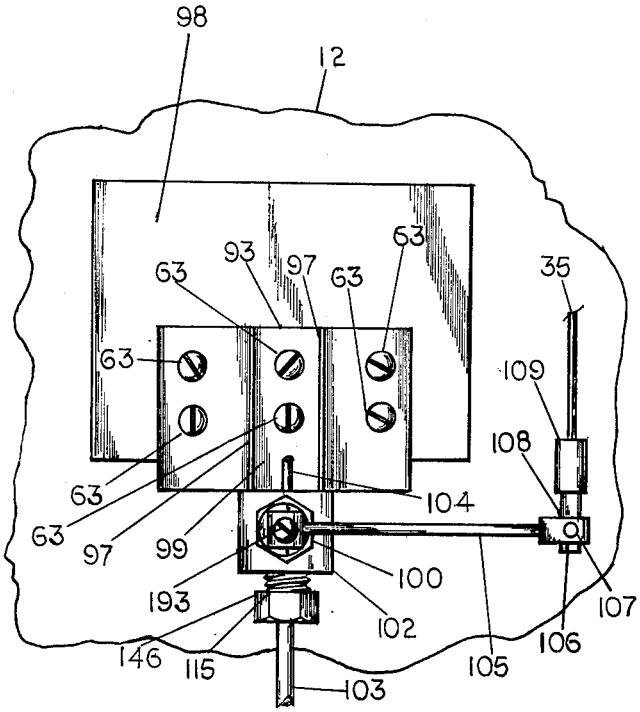
FIG. 11 is an elevational view of FIG. 10 showing mounting bracket and connecting linkage.

FIG. 11 is an elevational view of FIG. 10 showing water supply 103, water outlet 104 and valve actuating linkage 105 having clevis 106 threaded on one end to receive linkage 105. Clevis 106 is provided with a hole to receive hinge pin 107 or other suitable means passing through connecting link 108. Connecting link 108 protrudes from and is an integral part of a round threaded connector 109 which is threaded on its opposite end for receiving a threaded valve actuating rod 35.

FIG. 12 illustrates a section taken through FIG. 8 showing a complete assembly of the operating lever and conventional hot and cold water valves with a water outlet 104 supplying water to water spout 65 shown in FIGS. 7 and 8.

Figure 13:
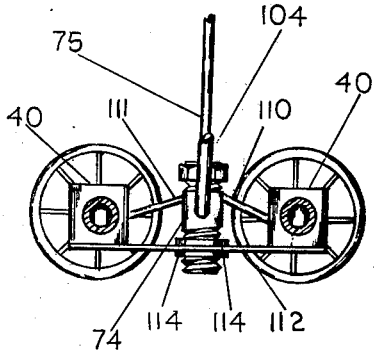
FIG. 13 is an elevational view of a combination hot and cold water control valve mounted between water supply shut-off valves.

FIG. 13 shows a conventional water valve 74 mounted between two water supply shut-off valves 40 having a water valve control rod 75 connected to valve stem 38 of valve 74 by the threaded connector 32. The water supply pipe 104 is connected to water spout 65. Hot water supply pipe 110 and cold water supply pipe 111 are connected to conventional combination hot and cold water supply valve 74 with valve 74 being retained in a bracket 112 by nuts 114.

Figure 14:
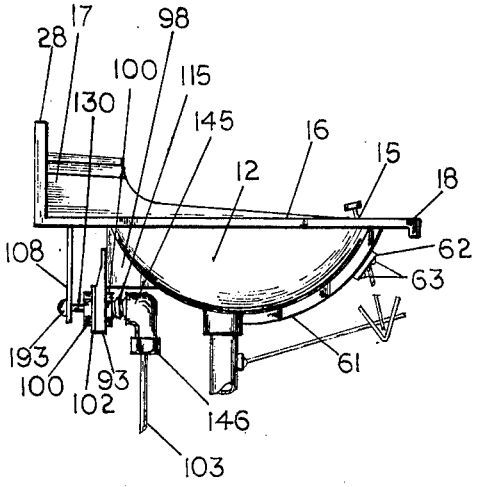
FIG. 14 is a side view of the lavatory showing pop-up valve linkage, water valve actuating rod and water valve mounted on a bracket attached to an extension of the sump wall.

FIG. 14 is a side elevation view of the lavatory shown in FIG. 1 having end wall 28, sump 12, rim 17 and pop-up drain lifting rod 15 located at rim 18 and capable of being connected to conventional pop-up drain linkage rod 15 passing through drain passage wall 61. The lavatory is similar to lavatory 10 shown in FIG. 1 having a valve actuating rod 105 extending below shelf 16 connected to valve lifting levers 19 and 21 and being connected to water valve 115 by lever arm 105 which is slidingly mounted on the end of valve stem 130. Stem 130 is provided with a splined end with lever arm 105 being provided with flutes matching splined shaft 130. Shaft 130 is further provided with a threaded hole to accommodate lever arm retaining screw 193. Water valve 115 is shown vertically positioned on mounting bracket 93 which in turn is vertically mounted on mounting block 98. Block 98 is a built-up projection of sump wall 12 with holes provided in plate 93 and threaded holes in mounting block 98 for receiving threaded fastening means 63 to retain plate 93 on mounting block 98. Plates 97 supported by plate 93 form a slot 99 for snugly receiving valve 115. Valve body 115 is connected to water supply pipe 103 by means of elbow 145 cooperating with threaded coupling nut 146.

Figure 15:
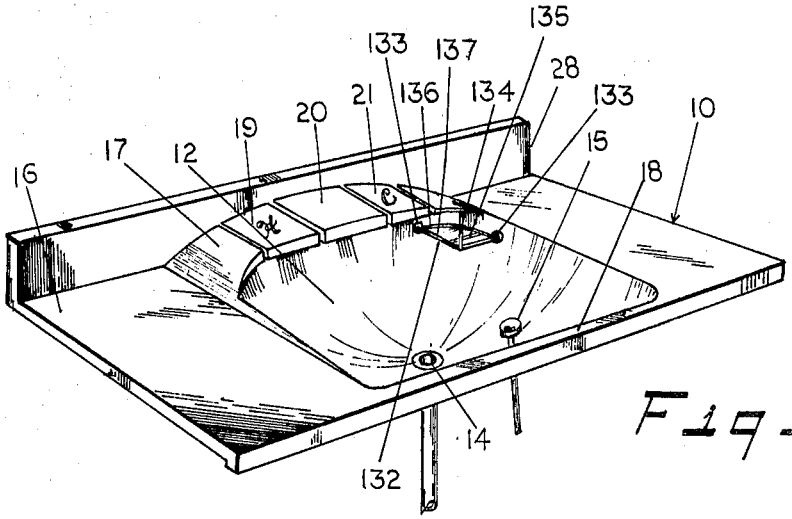
FIG. 15 is a partial isometric view of the lavatory having a cutaway view showing water control valves mounted under the rim, a water spout located in the rim and soap dish located under the rim.

Referring to FIG. 15, the soap dish is retained in position below rim 17 by means of holes 133 in the walls of sump section 12. The vertical rod hangar 134 and horizontal frame members 135 overlap and cooperate with edges of rim and sump wall holes 133 to retain dish 132 in its position below rim 17. This soap dish 132 is formed by horizontal straight side members 135 joined to curved member 136 and may be formed of metallic, plastic or other suitable synthetic or natural materials suitably welded, brazed, molded or joined together. As noted FIG. 15 is an isometric view of the easy to clean lavatory shown in a partially exploded view in FIG. 1.

Figure 16:
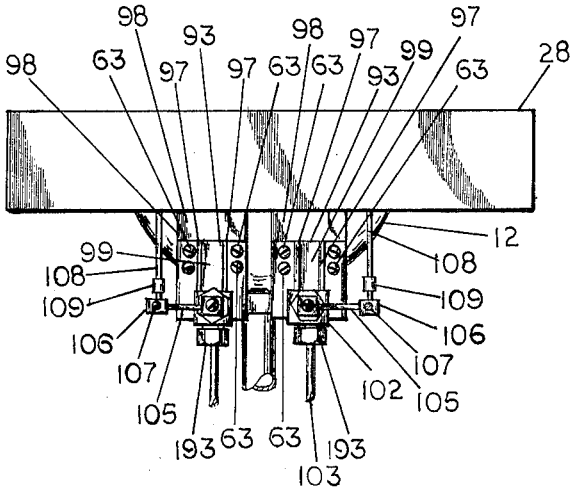
FIG. 16 is a rear view of FIG. 15.

FIG. 16 is a rear view of an easy to clean lavatory shown in FIGS. 1, 10 and 15.

Figure 17:
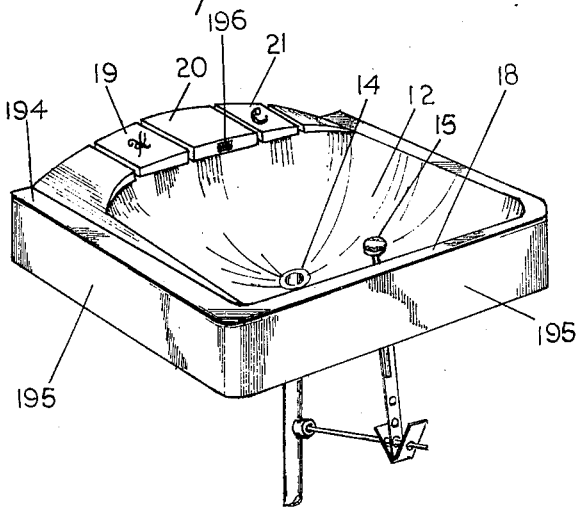
FIG. 17 is an isometric view of an easy to clean lavatory designed for wall mounting or installation in a cabinet.

FIG. 17 is a design of an easy to clean lavatory for wall mounting or installation in a cabinet top and having a conventional lavatory design except for the rim containing water spout and water valve actuating levers which are similar in design to the exploded view shown in FIG. 1. It discloses a rim 194 instead of a shelf 16 having four walls projecting downwardly from the rims 194 and 18. It should be noted that the water valve operating levers 19 and 21 each have a separate axis or fulcrum and they are operated by pressing the levers down to open the valve and pushing them up to close the valve. When the valves are closed the levers are coplanar with the rim of the sink. All movement of the levers occur by the hands of the user over the sink and no water from wet hands operating these levers reaches the rim of the sink.

Having now particularly described and ascertained the nature of my invention and the manner in which it is to be performed, it will be understood by those skilled in the art that the above description is illustrative rather than restrictive and that changes and modifications may be made without departing from the scope thereof as set forth in the appended claims.

What is claimed is:

1. A lavatory comprising:

a vertically arranged sump defining an opening having a rim around its periphery, said rim comprising first and second portions with said second portion positioned immediately adjacent to a user, said first portion of said rim comprising at least one rotatively mounted part movable out of alignment with said rim to function as a water valve control lever, said first portion of said rim overhanging and extending inwardly of the walls of said sump, means for pivotally connecting said part of said first portion of said rim at one point to a stem of a water valve and hingedly connecting said part at a point spaced therefrom to said rim, said means comprising a pin secured to said rim, and a spring fitted at least partially around said pin and fastened to said first part for normally biasing said first part to a position conforming with the outline of said first portion of said rim.

2. The lavatory set forth in claim 1 wherein:

said first portion of said rim is elevated vertically a greater distance than said second portion.

3. The lavatory set forth in claim 2 in further combination with:

a soap dish, and means for mounting said soap dish under said first portion of said rim.

4. The lavatory set forth in claim 1 in further combination with:

a water inlet valve, and said means comprising a linkage means for connecting said part of said rim to a stem of said water inlet valve, whereby rotation of said part away from said sump causes said water inlet valve to close.

5. The lavatory set forth in claim 4 in further combination with:

a water spout connected to said water inlet valve, said spout being arranged under said first portion of said rim.

6. The lavatory set forth in claim 1 wherein:

said first portion of said rim is divided into first and second parts with said first and second parts each being independently rotatably attached to said rim and movable out of alignment with said rim to each function as a water control lever.

7. The lavatory set forth in claim 1 in further combination with:

a drain in the bottom of said sump, a pop-up drain operating lever connected to said drain, a rod for operating said lever, said rod extending through said sump adjacent to said second portion of said rim and connected to the lever for controlling the opening and closing of said drain.

8. The lavatory set forth in claim 1 wherein:

said first portion of said rim is provided with a water spout detachably mounted thereon.

9. The lavatory set forth in claim 1 wherein:

said first portion of said rim is provided with a water spout hingedly attached thereto.

* * * * *